US005897258A

United States Patent [19]

Wen et al.

[11] Patent Number: 5,897,258

[45] Date of Patent: Apr. 27, 1999

[54] PLATEN-DRIVE THERMAL DYE PRINTER WITH CONE SHAPED SCUFF ROLLERS TRANSPORTING THE RECEIVER IN RECIPROCATING DIRECTIONS

[75] Inventors: Xin Wen, Rochester; John D. Delorme, Spencerport, both of N.Y.

[73] Assignee: Eastman Kodak Company, Rochester, N.Y.

[21] Appl. No.: 08/975,868

[22] Filed: Nov. 21, 1997

[51] Int. Cl.[6] ..... B41J 11/42

[52] U.S. Cl. ..... 400/579; 400/641; 400/642; 347/215; 347/220; 271/250; 271/251

[58] Field of Search ..... 400/579, 624, 400/629, 630, 633, 641, 642, 120.02; 347/104, 215, 218, 219, 220; 271/250, 251, 248, 240

[56] References Cited

U.S. PATENT DOCUMENTS

| | | | |
|---|---|---|---|
| 5,065,998 | 11/1991 | Salomon . | |
| 5,152,622 | 10/1992 | Rasmussen et al. | 400/642 |
| 5,211,390 | 5/1993 | Igaki . | |
| 5,235,353 | 8/1993 | Hirano et al. | 400/633 |
| 5,329,302 | 7/1994 | Fogle et al. . | |
| 5,460,457 | 10/1995 | Mindler et al. . | |
| 5,648,808 | 7/1997 | Yanagi et al. | 400/579 |

FOREIGN PATENT DOCUMENTS

| | | | |
|---|---|---|---|
| 40-1275171 | 11/1989 | Japan | 400/642 |
| 40-5069618 | 3/1993 | Japan | 400/579 |

OTHER PUBLICATIONS

"Paper Feed", Garrison et al, IBM Technical Disclosure Bulletin, vol. 22 No. 5 pp. 1746–1748, Oct. 1979.

"Improved Bidirectional Document Aligner" IBM Technical Disclosure Bulletin, vol. 30–No. 5 pp. 339–340, Oct. 1987.

"Document Aligner" Groenewald, IBM Technical Disclosure Bulletin, vol. 14, No. 3 p. 886, Aug. 1971.

*Primary Examiner*—Eugene Eickholt
*Attorney, Agent, or Firm*—Walter S. Stevens

[57] ABSTRACT

A platen-driven thermal dye printer mechanism (1), and more particularly to a cone-shaped scuff roller (7) which aligns a dye print receiver media sheet (2) with the receiver guide wall (8) during printing in a reciprocating direction (5). Using at least one conical shaped scuff roller (7) at one end of a platen roller (4) to transport the precut dye receiver media (2). The conical scuff roller (7) presses the back surface of the dye receiver media (2) against the non-imaging margin of the thermal dye printer mechanism (1). The invention uses a smooth guiding plate (28) and platen (4) thus, preventing scratches on the front surface of the receiver media (2). The invention is not subject to costly breakdowns, in that it uses the clockwise and counter-clockwise rotation of the platen (4) to provide perfect alignment of the receiver media (2) and printer head (9).

24 Claims, 5 Drawing Sheets

PLATEN-DRIVE THERMAL DYE PRINTER WITH CONE SHAPED SCUFF ROLLERS TRANSPORTING THE RECEIVER IN RECIPROCATING DIRECTIONS

FIELD OF THE INVENTION

The present invention relates to a platen-driven thermal dye printer mechanism, and more particularly to a cone-shaped scuff roller which aligns a dye print receiver media sheet with a receiver guide wall during printing in a reciprocating direction.

BACKGROUND OF THE INVENTION

Thermal dye printers typically use precut dye print receiver media sheets. During the print operation a receiver media sheet and donor roll are driven past the thermal print head leaving an imprint on the dye print receiver media. It is important that the receiver media pass the printer head in perfect alignment with the print head. In addition, the receiver media must pass at a constant rate to insure a good print quality. As disclosed in U.S. Pat. No. 5,205,663 a thermal print mechanism uses an elastic platen roller which is extended at both ends with high rigidity members that can hold the thermal receiver media sheet during and between the printing of color planes. One shortcoming of this design is associated with the difficulty of driving a sheet in a parallel path with two rollers in parallel planes on each side of the receiver media sheet. Often this arrangement causes bunching, crimping, or binding of the receiver media sheet when transported in reciprocating directions. U.S. Pat. No. 5,211,390 also discloses a sheet feeding device having a pair of rotatable rollers each having rotary shafts in parallel planes of the media receiver sheet.

Another problem associated with thermal print mechanisms is the use of grit rollers to feed and align the receiver media sheet. The grit has a tendency to fall off the rollers and damage the print head. U.S. Pat. No. 5,460,457 discloses a receiver media sheet picker mechanism. This device discloses a complex mechanical device having dual picker wheels connected by a wheel shaft. When actuated, the receiver media is urged along a print path towards the print mechanism. The problem associated with this arrangement is that the picker mechanism is subject to frequent mechanical break downs and its complex design adds to the cost of the thermal printer. Additionally, this arrangement does not accommodate both a forward and reverse direction of the dye receiver media.

SUMMARY OF THE INVENTION

The present invention as disclosed herein overcomes the problems set forth above. The invention uses at least one conical shaped scuff roller at one end of a platen roller to transport the precut dye receiver media and is configured in such a way that the scuff roller presses the back surface of the dye receiver media against the guiding plate in the non-imaging margin of the dye receiver media. The invention uses a smooth guiding plate and platen thus, preventing scratches on the front surface of the receiver media. The invention is not subject to costly receiver transport mechanism failures, in that it uses the clockwise and counter-clockwise rotation of the platen to provide perfect alignment of the receiver media and printer head. The invention contemplates the use of an elastomer layer on the conical scuff roller which assists in the alignment of the dye receiver media to the same guide wall in both the forward and reverse directions. More importantly, the invention provides a smoother transport during printing. This occurs because the platen is always the master driver during printing. The conical scuff roller is used only to steer the dye receiver media.

Additionally, the invention contemplates the use of two conical scuff rollers positioned in the front and rear of the printer head when using longer dye receiver media. The invention has a linear dye receiver media transport path with a printing speed range from between 2.5 ms–40 ms line time at resolutions in the range between 150–600 dpi. As a result, the invention as disclosed herein is able to deliver a thermal dye printer mechanism with both a forward printing and reverse action for providing picking, transport during picking, and ejection of the dye receiver media. The printer mechanism is lower in cost and smaller in size.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

There may be additional structures described in the foregoing application which are not depicted on one of the described drawings. In the event such a structure is described but not depicted in a drawing, the absence of such a drawing should not be considered as an omission of such design from the specification.

DETAILED DESCRIPTION OF THE INVENTION

Figure 1:
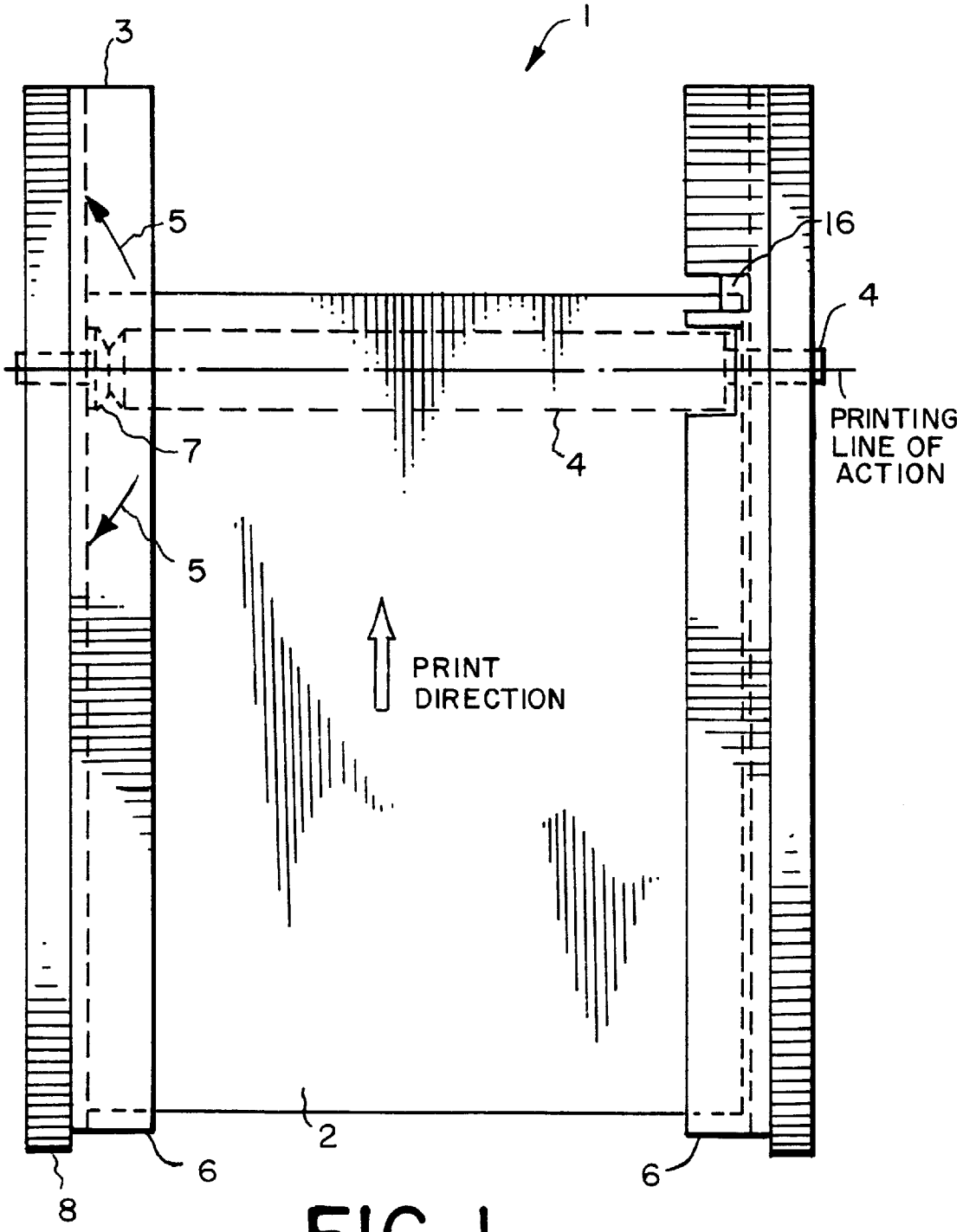
FIG. 1 shows a top view of the first embodiment of the invention.

FIG. 1 discloses a first embodiment of the invention. In a thermal printer mechanism 1 the dye receiver media 2 enters the device. The receiver media 2 enters by being hand fed into the entry/exit opening 3, or is fed from a hopper (not shown). The lead edge sensor 16 is activated by the receiver media 2 and the platen 4 begins to rotate. The platen 4 can be a roller comprising a steel core and elastic outer layer. The platen roller 4 can be driven by a DC motor through a servo system. As the platen 4 rotates it catches the bottom side of the receiver media 2 causing it to move unto the receiver guide 6. A conical scuff roller 7 is attached to one end of the platen 4. The conical scuff roller 7 asserts a steering direction 5 on the receiver media 2 aligning it with the guide wall 8.

Figure 2:
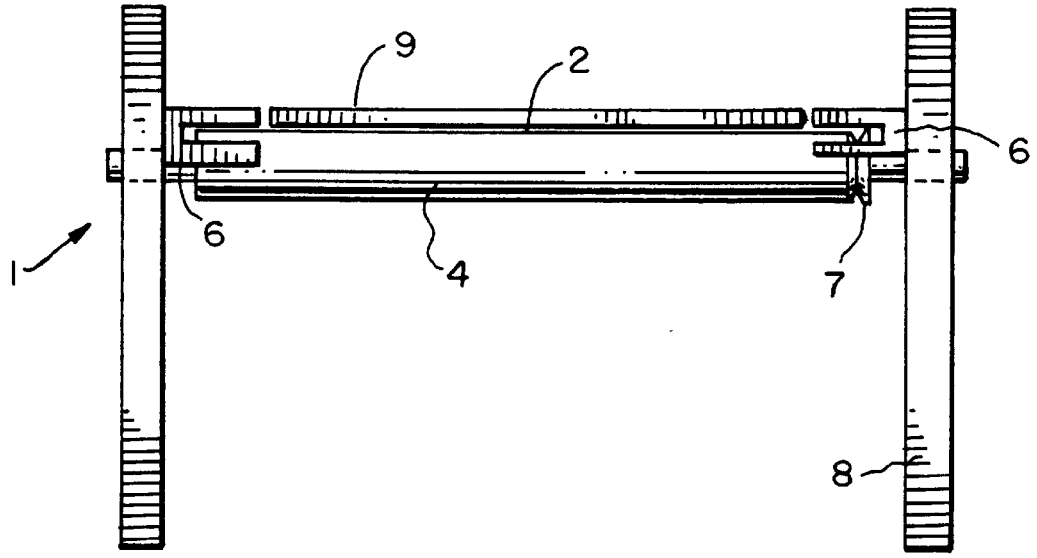
FIG. 2 shows a front view of the first embodiment of the invention.
Figure 3:
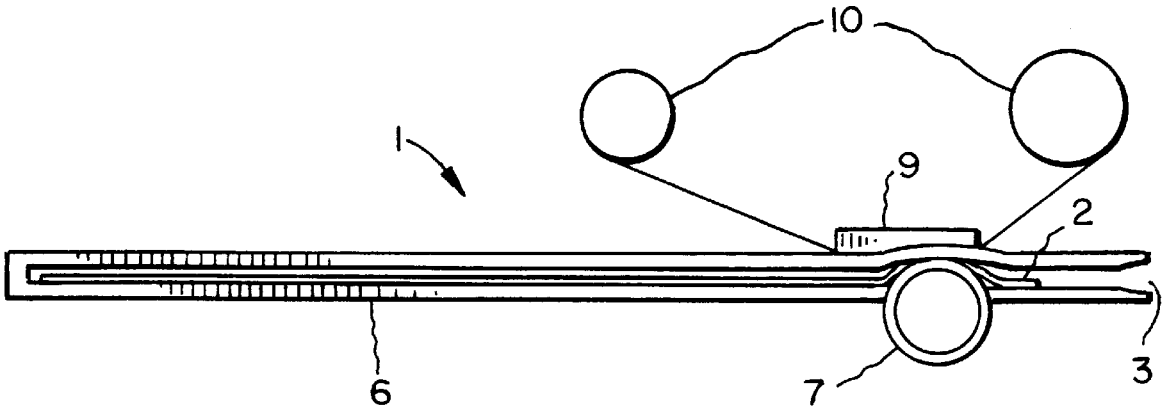
FIG. 3 shows a side view of the first embodiment of the invention.

As shown in FIGS. 2 and 3, the platen rotates at the underside of the print head 9. The conical scuff roller 7 is attached to the outer edge of one end of the platen 4. Thus, allowing for a close tolerance between the conical scuff roller 7 and the non-imaging area of the printer mechanism 1. The conical scuff roller 7 has an elastomer layer which causes it to display over-driving properties on the receiver media 2 and alignment against the guide wall 8. FIG. 3 shows the donor roll 10 passing under the print head 9 and across the top side of the receiver media 2.

Figure 4:
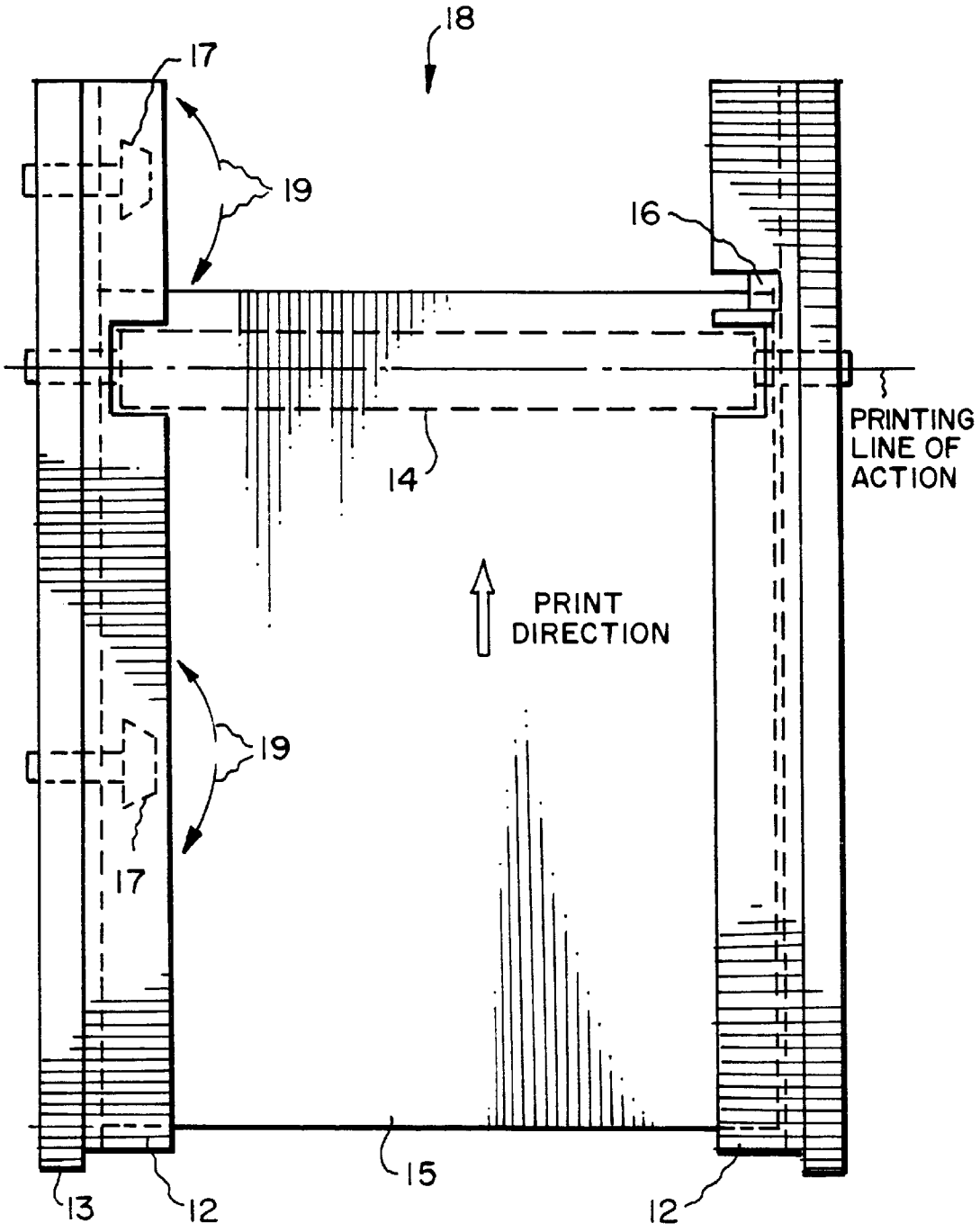
FIG. 4 shows a top view of the second embodiment of the invention.

FIG. 4 shows a second embodiment of the invention. This embodiment contemplates a thermal printer mechanism 18 having a plurality of receiver guides 12 one of which is attached to a guide wall 13. The platen 14 provides transport for the receiver media 15. The receiver media 15 is transported along the receiver guides 12 once the lead edge sensor 16 is activated. The conical scuff rollers 17 are mounted along the edge of the receiver guides 12. This embodiment mounts one of the conical scuff rollers 17 in front of the platen 14 and one at the rear of the platen 14. Placement of the conical scuff rollers 17 asserts maximum steering direction 19 on the receiver media 15 that is longer than the average media size, in both the forward print and reverse directions. Additionally, the use of two scuff rollers 17 increases the displacement distance needed for steering receiver media 15 toward the guide wall 13, for moving the receiver media 15 in the forward direction past the platen 14 and for removing receiver media 15 during the reversing action.

Figure 5:
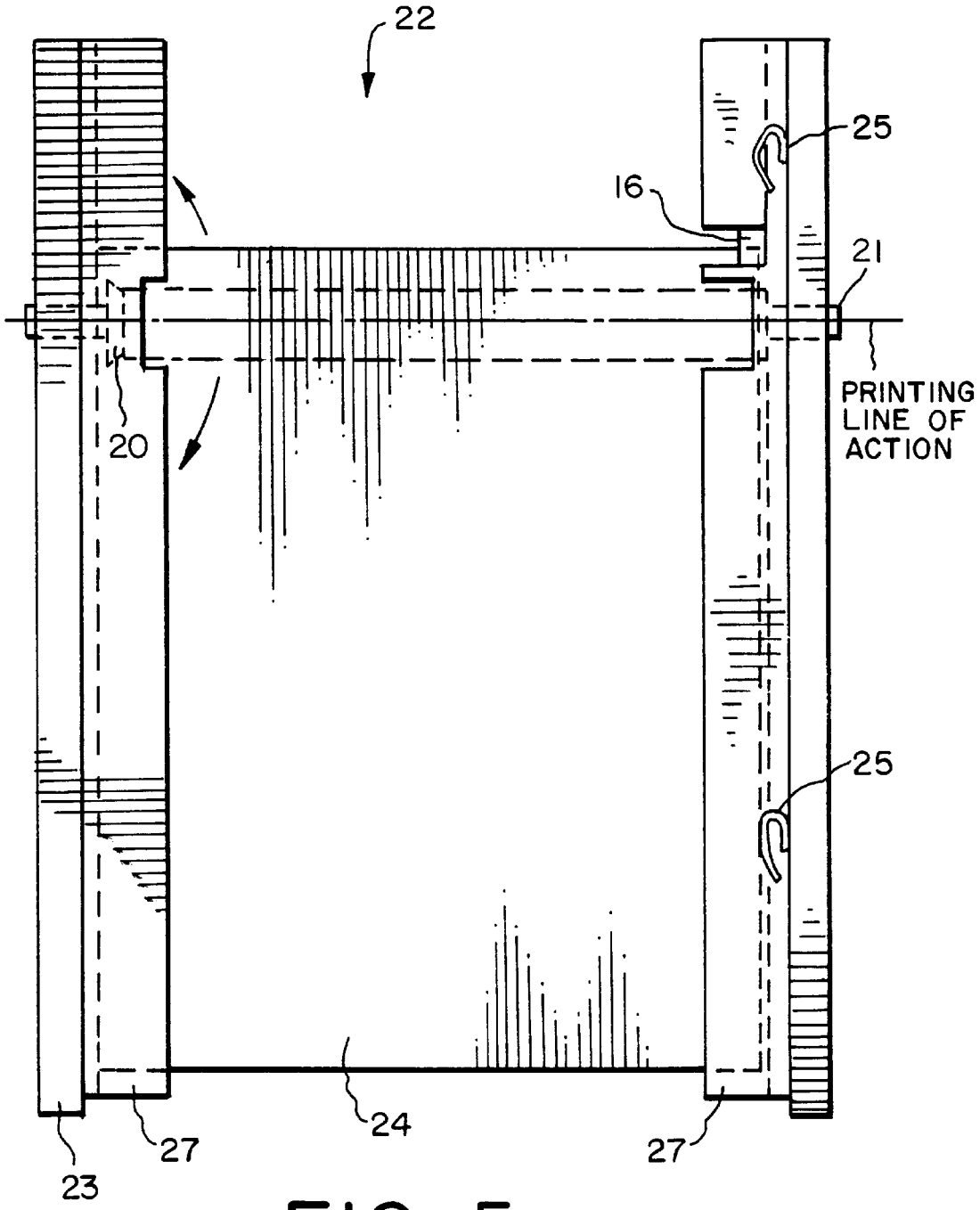
FIG. 5 shows a top view of the third embodiment of the invention.

FIG. 5 shows a third embodiment of the invention a thermal printer mechanism 22 comprising a conical scuff roller 20 attached to the platen 21. The conical scuff roller 20 is attached at one end of the platen 21 in a non-imaging area of the thermal printer mechanism 22. The conical scuff roller 20 urges the receiver media 24 against the guide wall 23. In addition, two push springs 25 are attached to the receiver guides 27 to assist the conical scuff roller 20. These push springs 25 are positioned in front of and in the rear of the platen 21. The push springs 25 help constrain the receiver media 24 against the guide wall 23, thus insuring that during the clockwise and counter-clockwise rotation of the platen 21 the receiver media 24 aligns against the guide wall 23.

Figure 6:
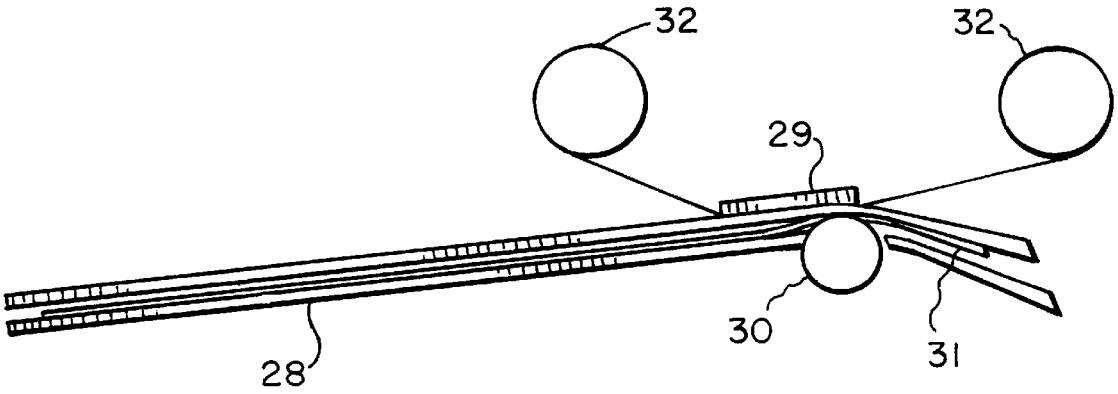
FIG. 6 shows a side view of the invention having the receiver plate angled away from the platen and printer head.

FIG. 6 shows the invention having a receiver guide plate 28 positioned on an angle away from the printer head 29 and conical scuff roller 30. This angle can range from between 30°–145° degrees. The wrap angle of the receiver media 31 is increased and thus the pressure at the print head 29. This is desirable in that it increases printing efficiency and uniformity, while providing better transfer between the donor roll 32 and dye print receiver media 31.

Further modification and variation can be made to the disclosed embodiments without departing from the subject and spirit of the invention as defined in the following claims. Such modifications and variations, as included within the scope of these claims, are meant to be considered part of the invention as described.

PARTS LIST

1. Thermal printer mechanism
2. Dye receiver media
3. Entry/exit opening
4. Platen
5. Steering direction
6. Receiver guide
7. Conical scuff roller
8. Guide wall
9. Print head
10. Donor roll
11. Print mechanism
12. Receiver guides
13. Guide wall
14. Platen
15. Receiver media
16. lead edge sensor
17. Conical scuff rollers
18. Thermal printer mechanism
19. Steering direction
20. Conical scuff roller
21. Platen
22. Thermal printer mechanism
23. Guide wall
24. Receiver media
25. Push springs
28. Receiver guide plate
29. Printer head
30. Conical scuff roller
31. Receiver media
32. Donor roll

What is claimed is:

1. A thermal printer mechanism having a thermal print head and a reciprocating receiver path using precut dye receiver media comprising:

a guide path having attached on two sides a receiver guide and guide wall;

a dye receiver transport for transporting said precut dye receiver media traversing said guide path and having the ability to rotate in both a clockwise and counter-clockwise motion, thereby causing said precut dye receiver media to travel through said thermal printer mechanism either in a forward or reverse direction; and an alignment member for aligning said precut dye receiver media in contact with a non-imaging area of said thermal print head and said precut dye receiver media whereby when said receiver media transport causes said precut dye receiver media to move, said precut dye receiver media aligns with said guide wall.

2. The thermal printer mechanism as recited in claim 1, wherein said receiver media transport comprises a platen roller.

3. The thermal printer mechanism as recited in claim 2, wherein said alignment member comprises a conical scuff roller.

4. The thermal printer mechanism as recited in claim 3 wherein said guide path is angled away from said conical scuff roller at a range from between 30°–145°.

5. The thermal printer mechanism as recited in claim 2, wherein said alignment member comprises a front and a rear conical scuff roller positioned before and after said platen roller.

6. The thermal printer mechanism as recited in claim 3, wherein said conical shaped scuff roller is attached to said platen roller.

7. The thermal printer mechanism as recited in claim 6, wherein said platen roller causes said conical scuff roller to move in either a clockwise or counterclockwise motion.

8. A thermal printer mechanism having a printer head, a non-imaging area, and a reciprocating receiver path using precut dye receiver media comprising:

a guide path having front and rear sides and attached on its opposite two sides a receiver guide and guide wall;

a dye receiver transport for transporting said precut dye receiver media traversing said guide path and said dye receiver transport including a platen roller having an ability to rotate in both a clockwise and counterclockwise motion, thereby causing said precut dye receiver media to travel either in a forward or reverse direction; and an alignment member for aligning said precut dye receiver media in contact with said non-imaging area and said precut dye receiver media, whereby when said dye receiver transport rotates said precut dye receiver media said precut dye receiver media is aligned with said guide wall.

9. The thermal printer mechanism as recited in claim 8 wherein said alignment member is a conical scuff roller attached to said dye receiver transport.

10. The thermal printer mechanism as recited in claim 9 wherein said alignment member further comprises a constraint for constraining said dye receiver media along said guide wall and said constraint being attached to said receiver guide and juxtaposed to said conical scuff roller.

11. The thermal printer mechanism as recited in claim 10 wherein said constraint is a push spring which constrain said dye receiver media against said opposite guide wall.

12. The thermal printer mechanism as recited in claim 9 wherein said guide path is angled away from said conical scuff roller at a range from between 30°–145°.

13. A method of using a thermal printer mechanism having a thermal print head and a reciprocating receiver path using precut dye receiver media, comprising the steps of:

(a) attaching a receiver guide and guide wall on two sides of a guide path;

(b) causing the precut dye receiver media to travel through the thermal printer mechanism either in a forward or reverse motion by disposing a dye receiver transport near the guide path for transporting the precut dye receiver media traversing the guide path, the dye receiver transport having an ability to rotate in both a clockwise and counterclockwise motion; and (c) aligning the precut dye receiver media into contact with a non-imaging area of the thermal print head and the precut dye receiver media by disposing an alignment member near the guide path, whereby the precut dye receiver media aligns with the guide wall as the receiver media transport causes the precut dye receiver media to move.

14. The method of claim 13, wherein the step of causing the precut dye receiver media to travel comprises the step of engaging the receiver media with a platen roller.

15. The method of claim 14, wherein the step of aligning the precut dye receiver media comprises the step of engaging the precut dye receiver media with a conical scuff roller near the guide path.

16. The method of claim 15, wherein the step of attaching a guide path comprises the step of attaching a guide path angled away from the conical scuff roller in a range between approximately 30° and 145°.

17. The method of claim 15, wherein the step of causing the precut dye receiver media to travel comprises the step of engaging the receiver media with a front and a rear conical scuff roller positioned before and after the platen roller, respectively.

18. The method of claim 15, wherein the step of aligning the precut dye receiver media in contact with the non-imaging area comprises the step of engaging the receiver media with a conical scuff roller attached to the platen roller.

19. The method of claim 18, further comprising the step of causing the platen roller to move the scuff roller in either a clockwise or counterclockwise motion.

20. A method of using a thermal printer mechanism having a thermal print head, a non-imaging area, and a reciprocating receiver path using precut dye receiver media comprising the steps of:

(a) attaching a guide path having front and rear sides and attached on its opposite two sides a receiver guide and guide wall;

(b) causing the precut dye receiver media to travel through the thermal printer mechanism either in a forward or reverse motion by disposing a dye receiver transport near said guide path for transporting said precut dye receiver media traversing the guide path and said dye receiver transport including a platen roller having an ability to rotate in both a clockwise and counterclockwise motion, thereby causing said precut dye receiver media to travel either in a forward or reverse direction; and (c) aligning said precut dye receiver media into contact with said non-imaging area of the thermal print head and said precut dye receiver media, by disposing an alignment member near the guide path, whereby when said platen roller rotates said precut dye receiver media moves in either a forward or reverse direction causing said alignment member to align said precut dye receiver media with said guide wall.

21. The method of claim 20, wherein the step of aligning said precut dye receiver media into contact comprises the step of engaging the precut dye receiver media with a conical scuff roller near the guide path.

22. The method of claim 21, wherein the step of attaching a receiver guide path further comprises the step of attaching a guide path angled away from said conical scuff roller in a range between approximately 30°–145°.

23. The method of claim 20, wherein the step of aligning said precut dye receiver media into contact further comprises the step of constraining the precut dye receiver media along the guide wall by a constraint attached to said receiver guide and juxtaposed to said conical scuff roller.

24. The method of claim 23, wherein the step of constraining said dye receiver media along the guide wall further comprises the step of attaching a push spring to said receiver guide for constraining said dye receiver media along the guide wall.

* * * * *